US006412630B2

(12) United States Patent
Focke et al.

(10) Patent No.: US 6,412,630 B2
(45) Date of Patent: Jul. 2, 2002

(54) CIGARETTE PACKET

(75) Inventors: Heinz Focke, Verden; Henry Buse, Visselhövede, both of (DE)

(73) Assignee: Focke & Co. (GmbH & Co.) (DE)

( * ) Notice: Subject to any disclaimer, the term of this patent is extended or adjusted under 35 U.S.C. 154(b) by 0 days.

(21) Appl. No.: 09/784,666

(22) Filed: Feb. 15, 2001

Related U.S. Application Data

(63) Continuation of application No. PCT/EP99/05397, filed on Jul. 28, 1999.

(51) Int. Cl.[7] ..... A24F 15/00
(52) U.S. Cl. ..... 206/268; 206/273; 206/831
(58) Field of Search ..... 206/246, 256, 206/265, 266, 268, 273, 831, 814; 220/523, 524

(56) References Cited

U.S. PATENT DOCUMENTS

| | | | | | |
|---|---|---|---|---|---|
| 558,445 | A | * | 4/1896 | Wander | 206/273 |
| 1,297,831 | A | * | 3/1919 | Gilbert | 206/265 |
| 2,617,578 | A | * | 11/1952 | Fischer | 206/265 |
| 2,983,424 | A | * | 5/1961 | Glass | 206/273 |
| 3,018,878 | A | | 1/1962 | Watkins | |
| 3,752,307 | A | | 8/1973 | German | |
| 5,379,889 | A | * | 1/1995 | Cobler | 206/268 |
| 5,558,217 | A | * | 9/1996 | Focke et al. | 206/268 |
| 6,050,402 | A | * | 4/2000 | Walter | 206/273 |

FOREIGN PATENT DOCUMENTS

| | | |
|---|---|---|
| DE | 17 47 772 | 6/1957 |
| DE | 26 34 958 A1 | 2/1978 |
| DE | 89 06 521 U | 1/1990 |
| DE | 90 11 464 U1 | 1/1991 |
| FR | 2.105.408 | 4/1972 |

* cited by examiner

*Primary Examiner*—Shian Luong
(74) *Attorney, Agent, or Firm*—Todd Deveau; Ryan A. Schneider; Troutman Sanders LLP

(57) ABSTRACT

Cigarette pack of the hinge-lid box type, comprising a box part (11) and a lid (12), there being formed, in the bottom region of the box part (11), an opening (25) which can be closed by a closure flap (24) formed as part of a blank of the hinge-lid box. The opening (25) and closure flap (24) extend around the corner in the region of a box rear wall (14) and of a base wall (17). In the region of the opening (25), a chamber (35) is formed within the hinge-lid box in order to accommodate, for example, folded printed carriers.

15 Claims, 4 Drawing Sheets

11
12
14
15
16
17
20
21
22
23
24
25
26
27
28
29
30
32
33
34
35
37

CIGARETTE PACKET

This application is a continuation of PCT/EP99/05397filed 28 Jul. 1999, which has foreign priority to German patent application 198 36 940.9, filed 18 Aug. 1998.

FIELD OF THE INVENTION

The invention relates to a pack made of (thin) cardboard, in particular a cigarette pack of the hinge-lid box (hinge-lid-pack) type, comprising a box part and a lid connected pivotably thereto, the box part comprising a box front wall, box rear wall, box side walls and a base wall. The invention also relates to a blank for producing such packs.

BACKGROUND OF THE INVENTION

The use of hinge-lid boxes as cigarette packs is widespread. In accordance with the conventional construction of a hinge-lid box, the lid is connected pivotably to a box rear wall in the region of a lid rear wall. Anchored in the box part is a collar which predominantly comprises a separate blank, partially projects out of the box part in the region of the box front wall and box side walls and is enclosed by the lid in the closed position of the hinge-lid box. The pack contents, namely a cigarette group, are enclosed by an inner wrapper made of paper, tin foil or the like and form a cigarette block which largely fills the interior of the hinge-lid box.

SUMMARY OF THE INVENTION

The object of the invention is to improve hinge-lid boxes, in particular for cigarettes, in terms of configuration and usability.

In order to achieve this object, the pack according to the invention is characterized in that an opening which can be closed by a closure flap is formed in the bottom region of the box part, adjacent to the base wall.

The (additional) opening formed in the box part makes it possible, in particular, to accommodate inserts accompanying the pack contents, in particular to arrange printing carriers with information, advertising or coupons for participation in prize draws etc., within the box part and to remove said insert separately, independently of the removal of the cigarettes. According to a further feature of the invention, the opening is formed in the region of the box rear wall and/or in the region of the base wall preferably such that the closure flap extends around the corner partially in the region of the box rear wall and partially in the region of the base wall. In the open position of the closure flap, this produces a (removable) opening which extends preferably centrally both in the region of the box rear wall and in the region of the base wall. A refinement in which a hinge line for the pivotability of the closure flap is formed in the region of the box rear wall, at a distance from, and parallel to, the base wall, is advantageous.

Particularly advantageous is a cigarette pack in which the pack contents, namely the cigarette block, are positioned at a distance from the base wall of the box part, in particular by lateral supporting elements formed within the box part. This produces, in the bottom region of the box part, a chamber for accommodating inserts, for example between the laterally arranged supporting elements for the cigarette block. The opening or the closure flap is positioned such that, in the open position, there is access to a chamber formed beneath the cigarette block.

The closure flap is designed such that one leg of the same acts as an insertion flap which, in the closed position, is positioned on the top side of the base wall or above the base corner tab.

A blank for producing hinge-lid boxes with a closeable opening in the box part is also of specific design. The closure flap is formed by punch lines or perforation lines provided during production of the blank.

BRIEF DESCRIPTION OF THE DRAWINGS

Further details of the pack according to the invention are explained in more detail hereinbelow with reference to the drawings, in which.

DETAILED DESCRIPTION OF A PREFERRED EMBODIMENT OF THE PRESENT INVENTION

Figures 1, 2, 3:
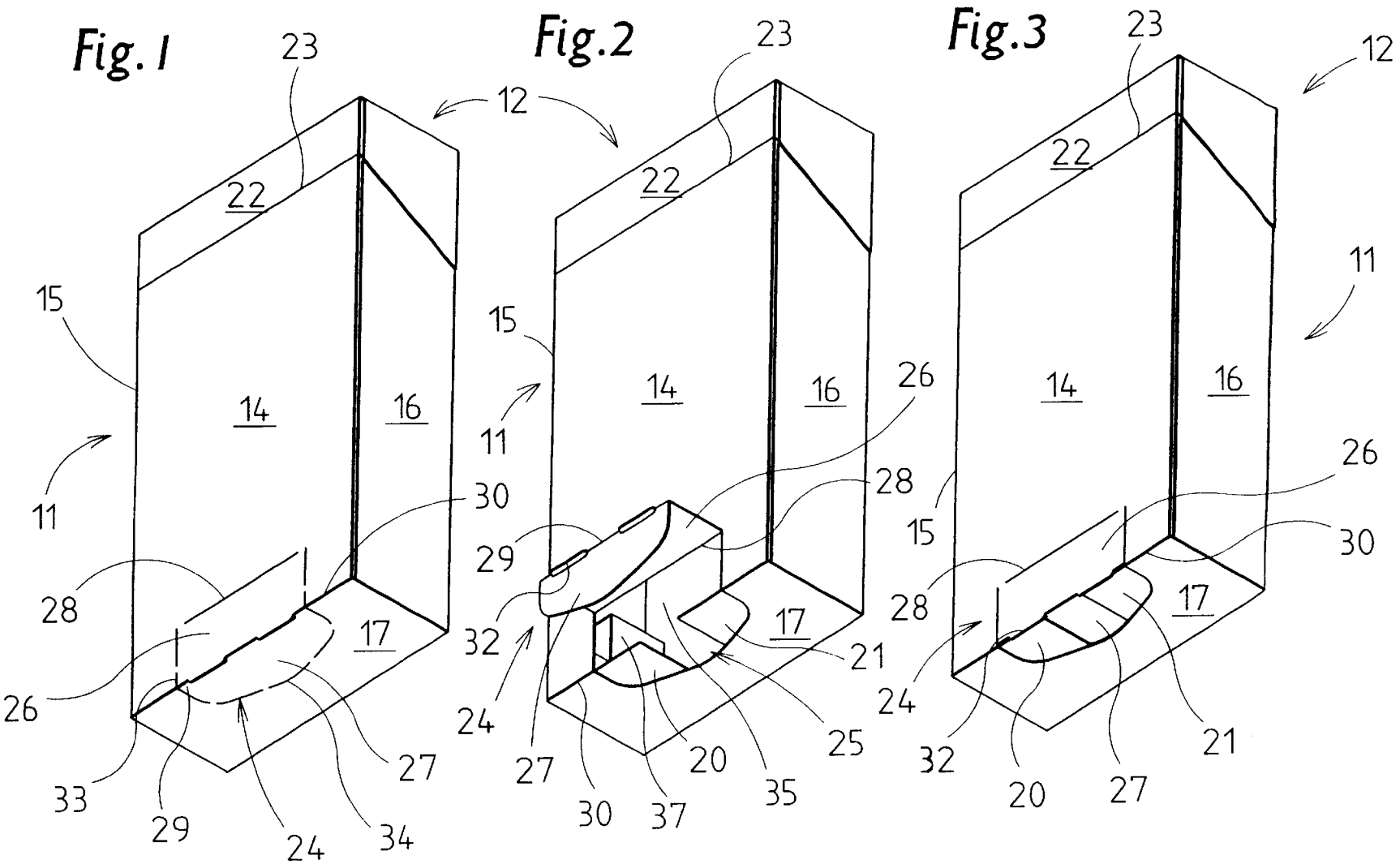
FIG. 1 shows a perspective bottom view of a hinge-lid box before a closure flap is opened for the first time.
FIG. 2 shows the pack according to FIG. 1 with the closure flap open.
FIG. 3 shows the pack with the closure flap located in the closed position.
Figure 4:
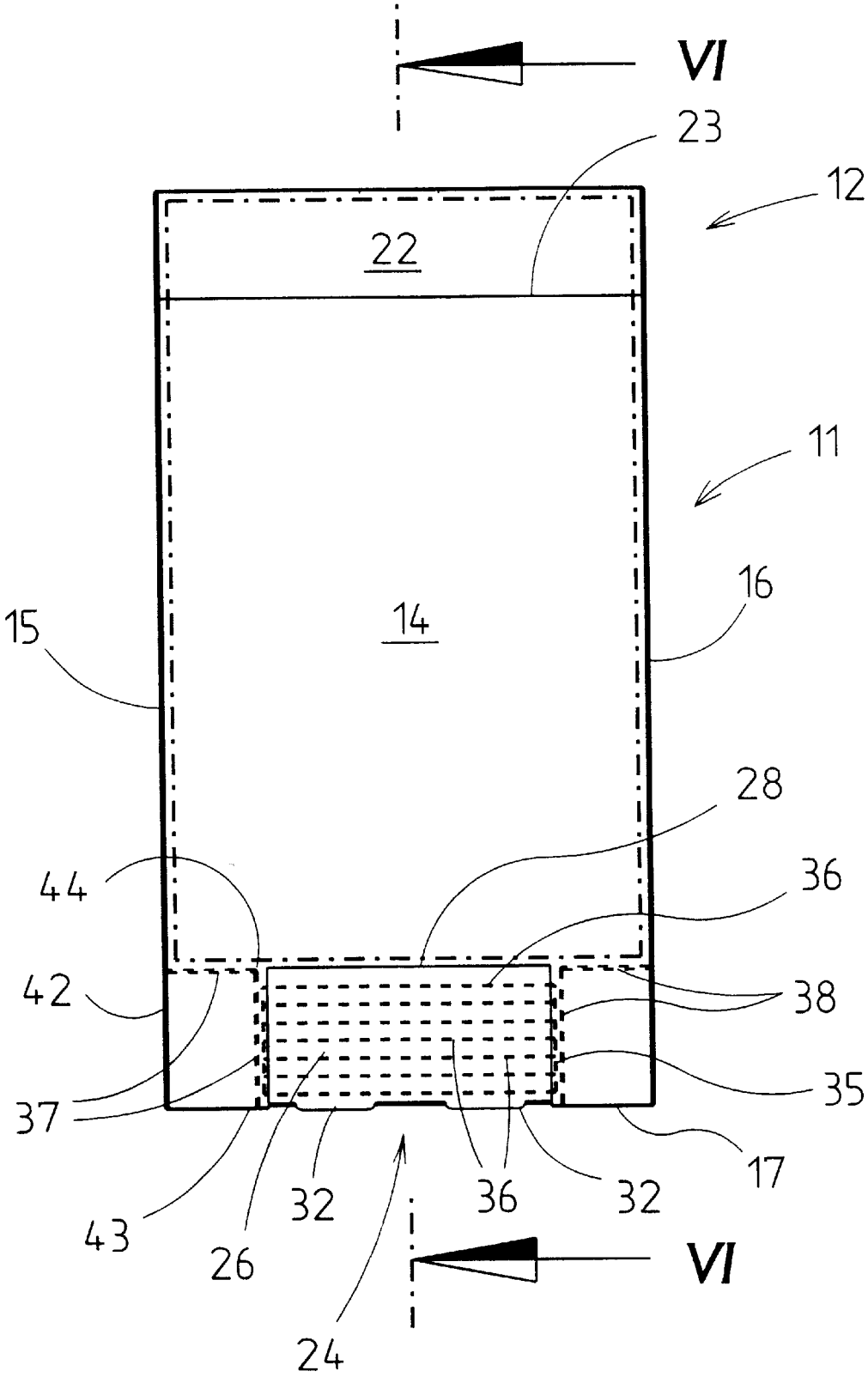
FIG. 4 shows a rear view of the hinge-lid box.

The drawings relate to the configuration of cigarette packs of the hinge-lid-box type. Accordingly, the contents of the cuboidal pack made of thin cardboard are formed by a group of cigarettes, which is wrapped by an inner blank made of paper, tin foil or the like and thus forms a more or less cuboidal cigarette block 10.

The hinge-lid box of standard construction for accommodating the cigarette block comprises a (bottom) box part 11 and a lid 12 connected integrally thereto. The box part 11 has a box front wall 13, a box rear wall 14, narrow, upright box side walls 15,16 and a base wall 17. The box side walls 15,16 each comprise two mutually overlapping side tabs 18 and 19. Inner side tabs 18 are connected to the box rear wall 14 and the outer side tabs 19 are connected to the box front wall. Base corner tabs 20,21 are provided on the inner side tabs 18. When folding of the hinge-lid box has been completed, said base corner tabs butt against the inside of the base wall 17.

The lid 12, which is designed analogously to the box part 11, is connected pivotably to the box rear wall 14 in the region of a lid rear wall 22 via a transversely directed articulation line 23.

The hinge-lid box is provided with a (further) opening 25 which can be closed by a closure flap 24. Said opening is located in the bottom part of the hinge-lid box or of the box part 11. In the preferred exemplary embodiment, the opening 25 extends around the corner, namely with one sub-region in the box rear wall 14 and with an adjoining sub-region in the base wall 17. The closure flap 24 is a corresponding, namely angled design. One leg 26 is part of the box rear wall 14. Another leg 27 is, at the same time, an insertion flap for the closure flap 24 for pushing into the hinge-lid box, namely into the box part 11.

Figure 5:
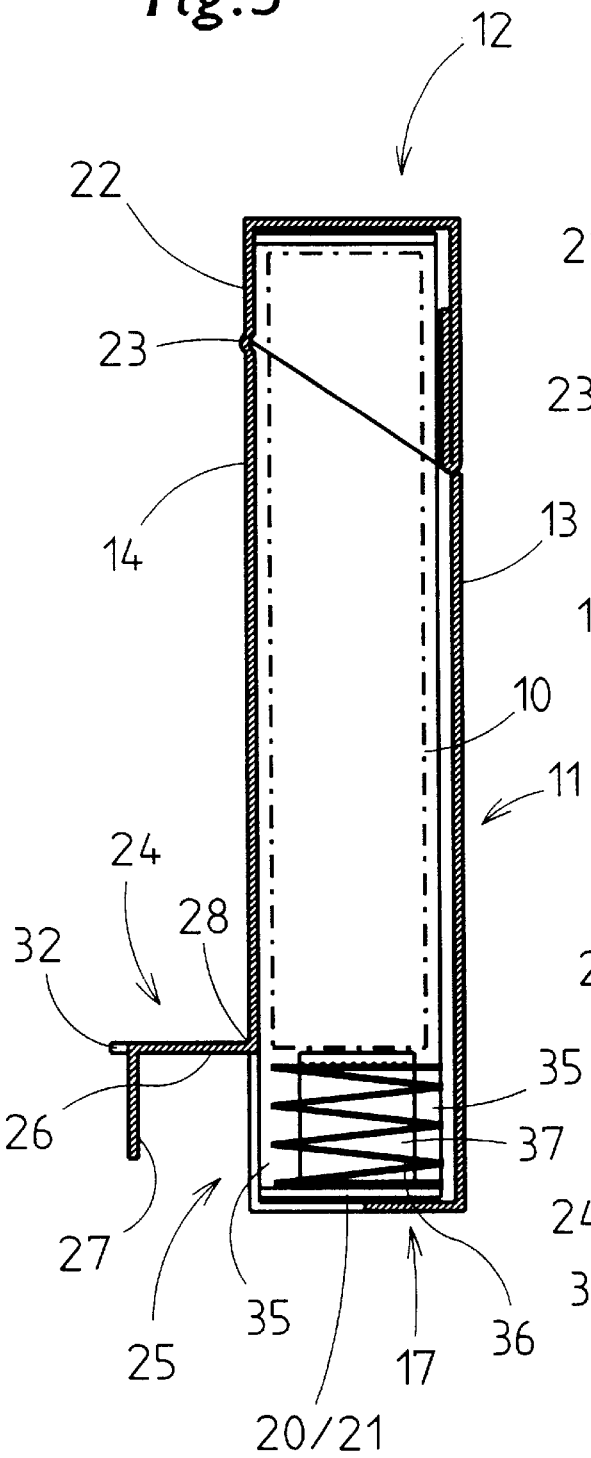
FIG. 5 shows the hinge-lid box according to FIG. 4 in vertical section with the closure flap open.
Figure 6:
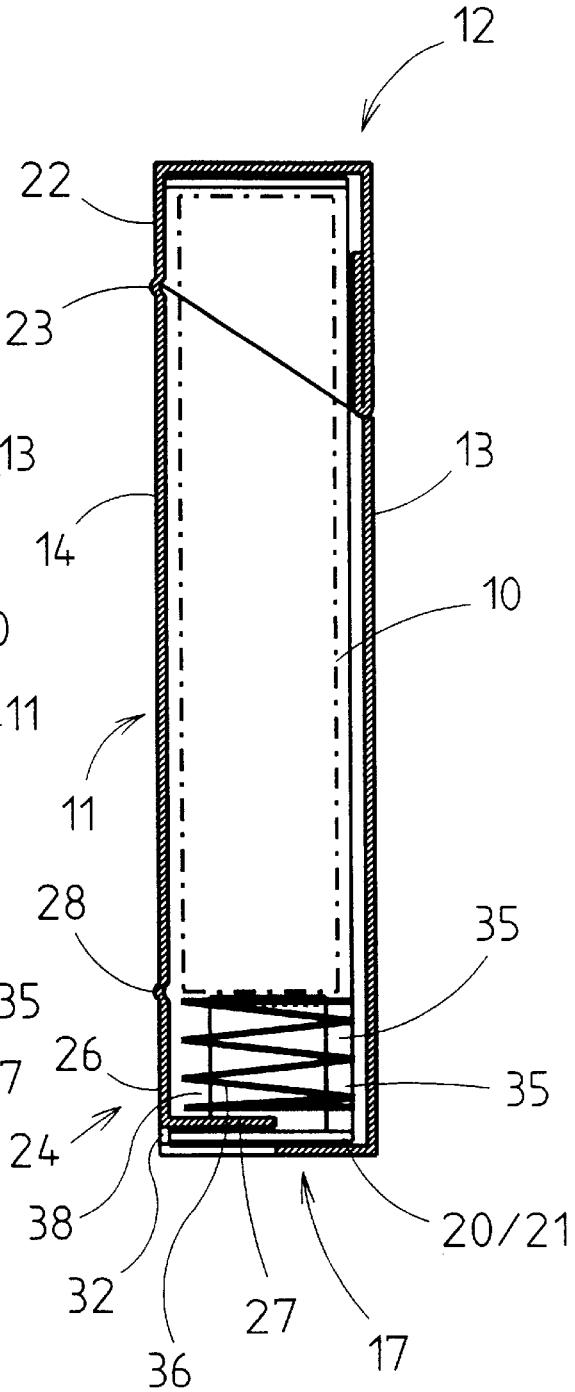
FIG. 6 shows a vertical section of the hinge-lid box according to FIG. 4 along section plane VI—VI.

The closure flap 24 is connected pivotably to the blank of the pack, to be precise to the box rear wall 14 via a transversely directed hinge line 28. For opening and closing purposes, the closure flap 24 can be pivoted about said hinge line 28 (FIGS. 5 and 6).

The two legs 26,27 are connected to one another in the region of a transversely directed line of inflection 29. The latter is designed as a continuation of a bottom, transversely directed folding edge 30 of the box part 11. The folding edge 30 separates off the box rear wall 14 from the base wall 17. The line of inflection 29 is of specific configuration, that is to say it is provided with flat, U-shaped punchings 31. These bound small and narrow tongues 32 in extension or continuation of the leg 26. In the closed position of the closure flap 24, the tongues 32 butt, as a stop or supporting element, against a pack part, namely against base corner tabs 20,21, which rest on the base wall 17 on the inside.

Figure 7:
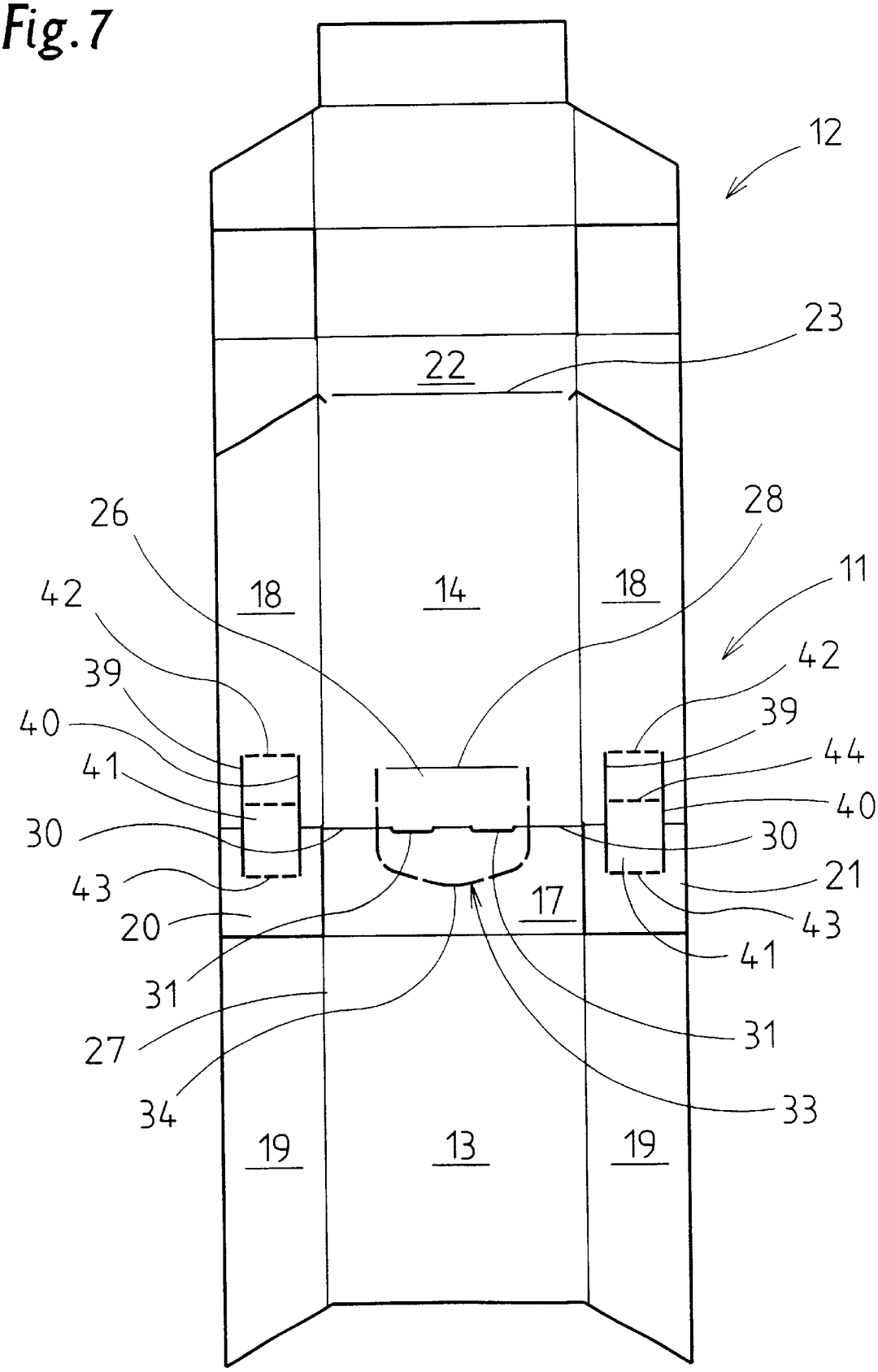
FIG. 7 shows a blank for producing a hinge-lid box according to FIGS. 1 to 6.

The closure flap 24 is part of the blank of the pack. The tongue-like closure flap 24 is defined within the blank (FIG. 7) by an essentially U-shaped or V-shaped punch line 33. A central, continuous punch cut 34 makes it easier for the closure flap 24 to be severed from the blank.

In the closed position, the closure flap 24 is fixed by insertion into the pack. The horizontal leg 27 serves as insertion flap here. The leg 27 is introduced into the box part 11 such that the leg 27 is positioned in a plane above the base corner tabs 20,21 (FIGS. 3 and 6). The base corner tabs 20,21 retain the leg 27 in the closed position. In this case, the opening 25 is configured and/or dimensioned such that, in the region of the base wall 17, it is partially overlapped by the base corner tabs 20,21 (FIG. 2).

The pack, in particular hinge-lid box with closure flap 24, can be used particularly advantageously if the pack contents have, namely the cigarette block 10 has, a lower height than the (inner) height of the hinge-lid box. This results, in the bottom region, namely beneath the cigarette block 10, in a chamber 35 in the interior of the box part 11. Said chamber 35 may serve for accommodating pack inserts. In the exemplary embodiment shown, a printing carrier 36 is positioned in the bottom part of the hinge-lid box, namely in the chamber 35. Said printing carrier is a thin blank which is printed with information, advertising, etc. and is suitable, if appropriate, as a coupon for participation in prize draws. The printing carrier 36 is folded in the manner of an accordion and positioned in this way within the chamber 35. The printing carrier 36 can be removed from the chamber 35 via the opening 25.

In hinge-lid boxes with the cigarette block 10 being of relatively low height, the arrangement of supporting elements in the bottom region of the box part 11 is expedient. In the present case, two lateral supporting elements 37,38 are provided, the cigarette block 10 resting thereon. The chamber 35 is formed between the supporting elements 37,38. The printing carrier 36 is formed with corresponding dimensions in order to be fitted in the chamber 35.

The supporting elements 37,38 are formed from the blank of the hinge-lid box by punching and folding operations, to be precise analogously to U.S. Pat. No. 4,241,827. For this purpose, the blank is provided, in the region of the inner side tabs 18 and of the base corner tabs 20,21 connected thereto, with two parallel severing cuts 39,40. These define a folding flap 41. Formed at the ends of the same are folding lines 42,43, which are marked by dashed lines and, in interaction with a further, eccentrically arranged folding line 44, make it possible for the folding flap 41 to be set in an angular upright position. During the production of the hinge-lid box, angled supporting elements 37,38 for the cigarette block 10 are thus produced at the corner and border regions of the base wall 17.

It is also possible for the closure flap 24 to be positioned analogously at some other location of the hinge-lid box, for example in the region of the box front wall 13 and base wall 17, but also around the corner from the box front wall 13 or box rear wall 14, on the one hand, and box side walls 15,16, on the other hand.

List of Designations

10 Cigarette block
11 Box part
12 Lid
13 Box front wall
14 Box rear wall
15 Box side wall
16 Box side wall
17 Base wall
18 Side tab
19 Side tab
20 Base corner tab
21 Base corner tab
22 Lid rear wall
23 Articulation line
24 Closure flap
25 Opening
26 Leg
27 Leg
28 Hinge line
29 Line of inflection
30 Folding edge
31 Punching
32 Tongue
33 Punch line
34 Punch cut
35 Chamber
36 Printing carrier
37 Supporting element
38 Supporting element
39 Severing cut
40 Severing cut
41 Folding flap
42 Folding line
43 Folding line
44 Folding line

What is claimed is:

1. A pack made of cardboard, in particular a hinge-lid box, comprising:

a box part incorporating a top region and a bottom region, the box part formed by a box front wall, a box rear wall, box side walls and a box base wall;

a lid connected to the top region of the box part; an angled closure flap for closing a closeable opening in the bottom region of the box part when the angled closure flap is in a closed position; and base corner tabs that butt against the box base wall on the inside of the box part, each base corner tab connected to a respective box side wall;

the angled closure flap incorporating a first leg and a second leg, and connected to the box rear wall via a transversely directed hinge articulation between the box rear wall and the first leg;

wherein when the angled closure flap is in the closed position, the angled closure flap is anchored to the box part by the hinge articulation and the second leg being positioned above the base corner tabs.

2. The pack as claimed in claim 1, wherein the closeable opening and the angled closure flap extend, by way of one sub-region, within the box rear wall and, by way of another sub-region, within the base wall.

3. The pack as claimed in claim 1, wherein the angled closure flap is defined within a blank for the pack by a weakening line, wherein removal of the residual connections in the region of the weakening line enables the angled closure flap to be severed from the box rear wall and the box base wall.

4. The pack as claimed in claim 3, wherein the angled closure flap has stops which, in the closed position, butt against edges of the pack, in particular tongues which are formed in the region of a line of inflection between the first and second legs and butt against the bas corner tabs.

5. The pack as claimed in claim 3, wherein in the region of the closeable opening, a chamber is formed within the pack in order to accommodate pack inserts.

6. The pack as claimed in claim 3, wherein the chamber is formed beneath a cigarette block as contents of the pack, between lateral supporting elements on which the cigarette block rests.

7. The pack as claimed in claim 3, wherein in the region of the closeable opening, a chamber is formed within the pack in order to accommodate printed carriers.

8. The pack as claimed in claim 1, wherein the angled closure flap has stops which, in the closed position, butt against edges of the pack, in particular tongues which are formed in a region of a line of inflection between the first and second legs and butt against the base corner tabs.

9. The pack as claimed in claim 8, wherein in the region of the closeable opening, a chamber is formed within the pack in order to accommodate pack inserts.

10. The pack as claimed in claim 8, wherein the chamber is formed beneath a cigarette block as contents of the pack, between lateral supporting elements on which the cigarette block rests.

11. The pack as claimed in claim 8, wherein in the region of the closeable opening, a chamber is formed within the pack in order to accommodate printed carriers.

12. The pack as claimed in claim 1, wherein in the region of the closeable opening, a chamber is formed within the pack in order to accommodate pack inserts.

13. The pack as claimed in claim 12, wherein the chamber is formed beneath a cigarette block as contents of the pack, between lateral supporting elements on which the cigarette block rests.

14. The pack as claimed in claim 12, wherein the chamber is formed beneath a cigarette block as contents of the pack, between lateral supporting elements on which the cigarette block rests.

15. The pack as claimed in claim 1, wherein in the region of the closeable opening, a chamber is formed within the pack in order to accommodate printed carriers.

* * * * *